US009016423B2

(12) United States Patent
Wetterich

(10) Patent No.: US 9,016,423 B2
(45) Date of Patent: Apr. 28, 2015

(54) PLATFORM SYSTEM FOR AN ARTICULATED MACHINE

(71) Applicant: Caterpillar Inc., Peoria, IL (US)

(72) Inventor: Dennis D. Wetterich, Newark, IL (US)

(73) Assignee: Caterpillar Inc., Peoria, IL (US)

( * ) Notice: Subject to any disclaimer, the term of this patent is extended or adjusted under 35 U.S.C. 154(b) by 111 days.

(21) Appl. No.: 13/721,284

(22) Filed: Dec. 20, 2012

(65) Prior Publication Data

US 2014/0175772 A1 Jun. 26, 2014

(51) Int. Cl.
*B62D 49/06* (2006.01)
*E02F 9/08* (2006.01)

(52) U.S. Cl.
CPC ..... *E02F 9/0833* (2013.01); *E02F 9/0841* (2013.01)

(58) Field of Classification Search
USPC ..... 180/89.12, 235, 418
See application file for complete search history.

(56) References Cited

U.S. PATENT DOCUMENTS 3,237,790 A * 3/1966 Kampert et al. ..... 414/687
3,253,671 A * 5/1966 Fielding ..... 180/235
3,326,312 A * 6/1967 Buller ..... 180/14.1
3,439,937 A * 4/1969 Dixon ..... 280/426
4,240,648 A 12/1980 Starr
6,409,459 B1 6/2002 Ginn et al.
7,354,050 B2 4/2008 Brockway
7,905,324 B2 3/2011 Gil et al.
8,011,474 B2 9/2011 Boroski et al.
2010/0154401 A1 6/2010 Sullivan, Jr. et al.
2011/0024213 A1 2/2011 Giovannini et al.
2012/0145471 A1 6/2012 Tan et al.

OTHER PUBLICATIONS

United States Statutory Invention Registration H1,846, Apr. 4, 2000, Poorman.

* cited by examiner

*Primary Examiner* — Tony Winner
(74) *Attorney, Agent, or Firm* — William Tinker

(57) ABSTRACT

A platform system for an articulated machine is disclosed. The platform system can include a first platform which can be pivotally supported by a front frame of an articulated machine. The front frame of the articulated machine can be pivotally coupled to a rear frame of the articulated machine at an articulation joint. A second platform can be pivotally supported by the rear frame of the articulated machine. The second platform can include a first edge which can be positioned adjacent to a first edge of the first platform. Each of the first edge of the first platform and the first edge of the second frame platform can have a radial profile which can be aligned with a path of pivotal movement between the first platform and the second frame platform.

19 Claims, 5 Drawing Sheets

PLATFORM SYSTEM FOR AN ARTICULATED MACHINE

TECHNICAL FIELD

The present disclosure relates to a platform system, and more particularly, to a platform system for an articulating work machine.

BACKGROUND

A variety of different articulated machines, including but not limited to wheel loaders, scrapers, motor graders, articulated trucks, and the like, may be utilized for a variety of different purposes. Such articulated machines may include individual frame members which may be pivotally coupled together in a manner to provide relative articulating movement and/or positioning between the frame members. Additionally, an operators station which may include a cab may be positioned on, within, or may be otherwise associated with one of the individual frame members of the articulated machine. Although an operator may have limited access to certain portions of the particular individual frame member proximate to the position at which the operators station and/or cab is located, accessing frame members and portions thereof remote from the frame member and operators station may be inconvenient, difficult, and/or dangerous . An operator may need such access to perform activities including but not limited to inspection, cleaning, maintenance, and/or servicing of these various components of the articulated machine. The various orientations or articulated positions between the individual frame members as well as the large sizes of many such articulated machines may further complicate such access to portions of the frame members.

U.S. Pat. No. 7,354,050 B2 (the '050 patent) to Brockway discloses a swing-away stair assembly which facilitates movement of the stair assembly from its operational position to an access position. The swing-away stair assembly includes a pivot bracket assembly for supporting a stair body for pivotal movement on a work machine. The pivot bracket provides a pivot axis for the stair body which is located laterally outwardly from a lateral side of the work machine, and the stair body is supported for movement around a rear wheel of the work machine and is capable of 180° of pivotal movement between an operational position extending over the rear wheel and an access position displaced from the rear wheel. Although the pivot configuration disclosed by the '050 patent may permit the stair body to be pivoted away from the machine without requiring removal of a rear wheel of the machine whereby a worker may access lateral side panels adjacent to the rear wheel, the '050 patent may not provide sufficient access to frame members and portions thereof remote from the frame member and operators station at, upon, or within which the cab may be located.

The present disclosure is directed to mitigating or eliminating one or more of the drawbacks discussed above.

SUMMARY

One aspect of the present disclosure is directed to a platform system for an articulated machine. The platform system can include a first platform which can be pivotally supported by a front frame of an articulated machine. The front frame of the articulated machine can be pivotally coupled to a rear frame of the articulated machine at an articulation joint. A second platform can be pivotally supported by the rear frame of the articulated machine. The second platform can include a first edge which can be positioned adjacent to a first edge of the first platform. Each of the first edge of the first platform and the first edge of the second frame platform can have a radial profile which can be aligned with a path of pivotal movement between the first platform and the second frame platform.

Another aspect of the present disclosure is directed to a platform system. The platform system can include a first platform which can be pivotally supported by a front frame of an articulated machine. The front frame of the articulated machine can be pivotally coupled to a rear frame of the articulated machine at an articulation joint. A second platform can be pivotally supported by the rear frame of the articulated machine. The first platform can have an interior edge which can extend between a first side edge and a second side edge of the first platform. The second platform can have an interior edge which can extend between a first side edge and a second side edge of the second platform. The platform system can include an evenly spaced pivotal interface between adjacent portions of the interior edge of the first platform and the interior edge of the second platform. One or more side guard rails can be positioned along each of the first side edge and the second side edge of the first platform and the first side edge and the second side edge of the second platform.

DETAILED DESCRIPTION

Reference now will be made in detail to exemplary embodiments that are illustrated in the accompanying drawings. Wherever possible, the same reference numbers will be used throughout the drawings to refer to the same or like parts.

Figure 1:
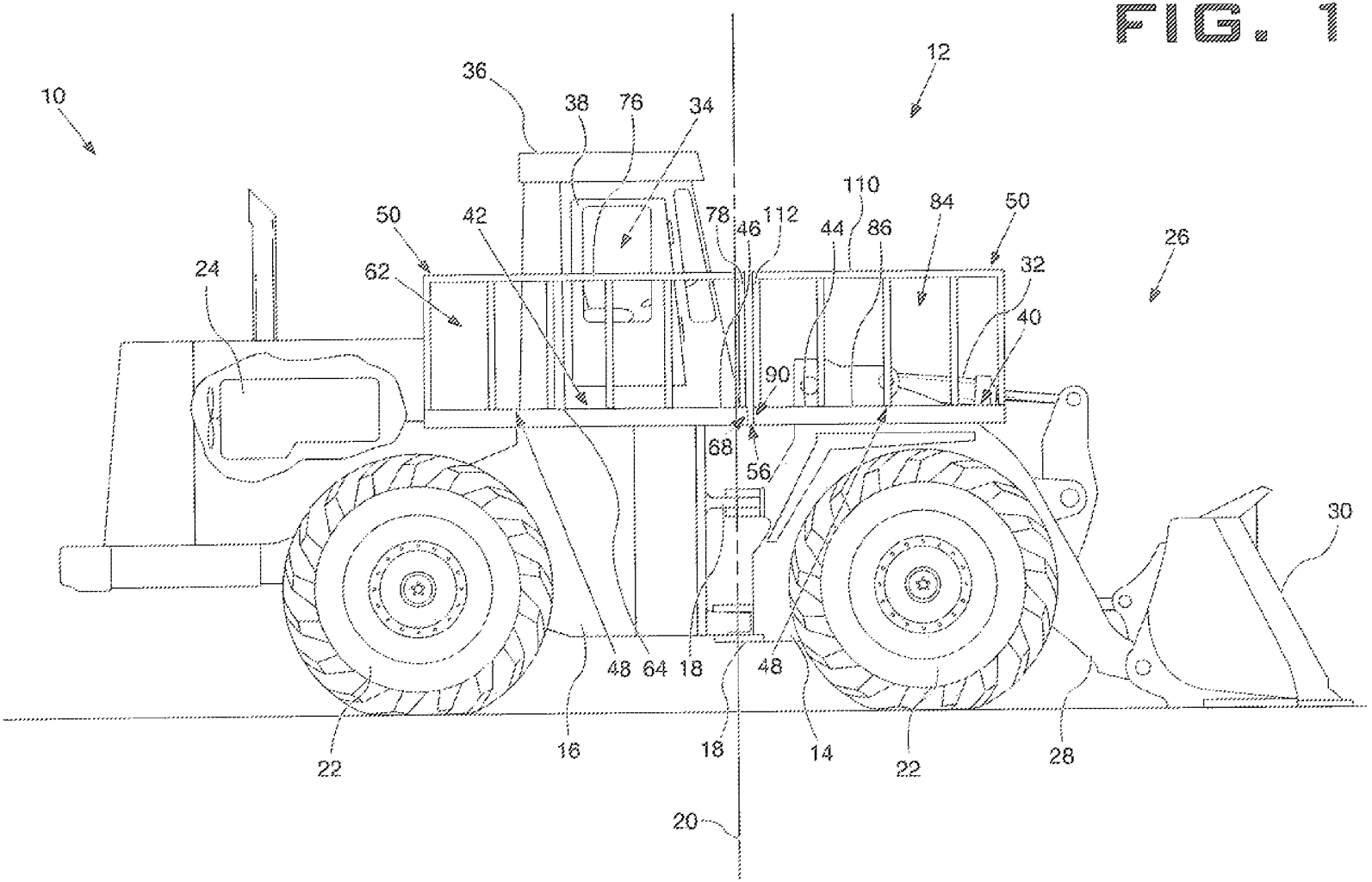
FIG. 1 is a side elevation view of an exemplary disclosed platform system for an articulated machine.
Figure 2:
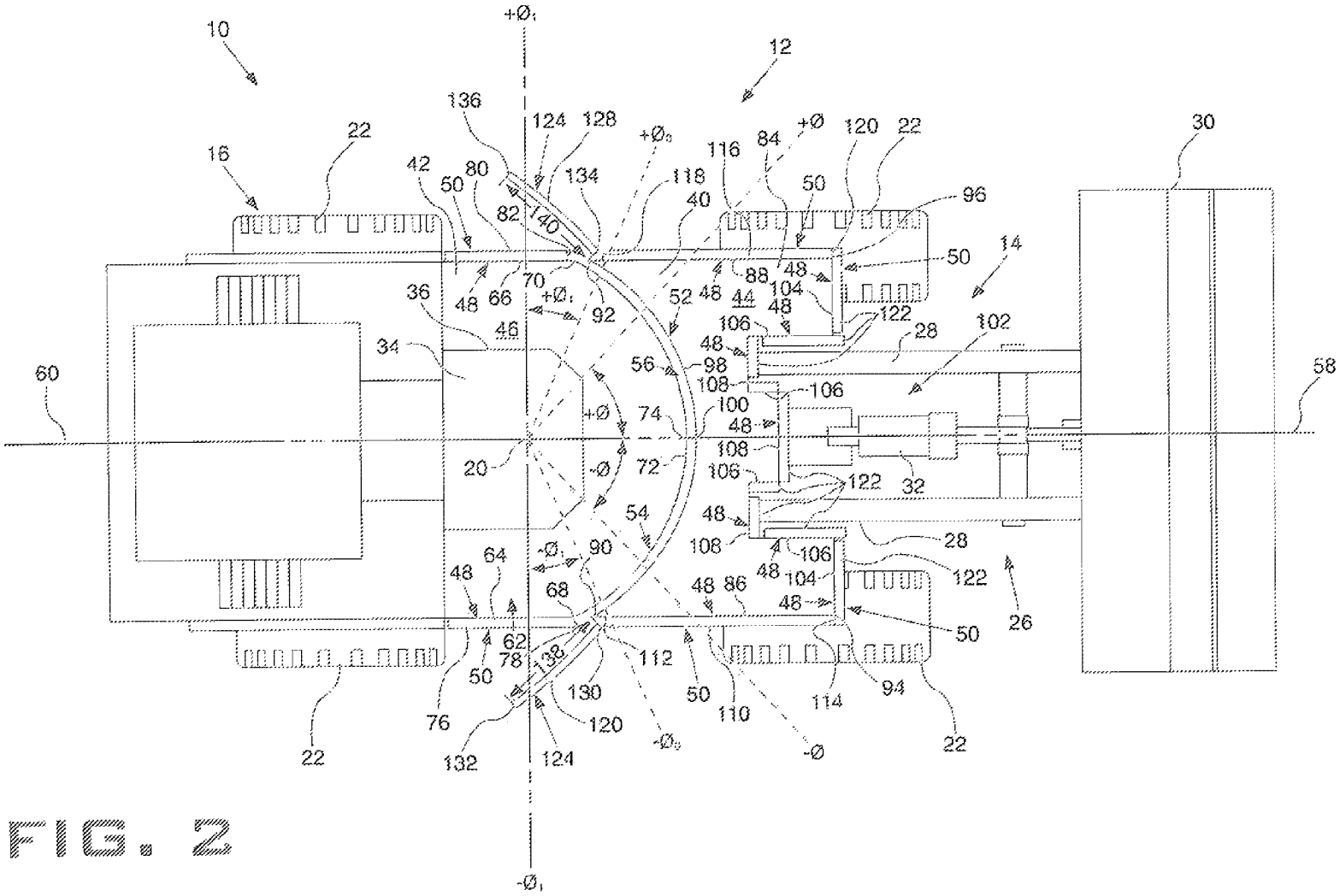
FIG. 2 is a top plan view of an exemplary disclosed platform system for an articulated machine in an un-articulated position.
Figure 3:
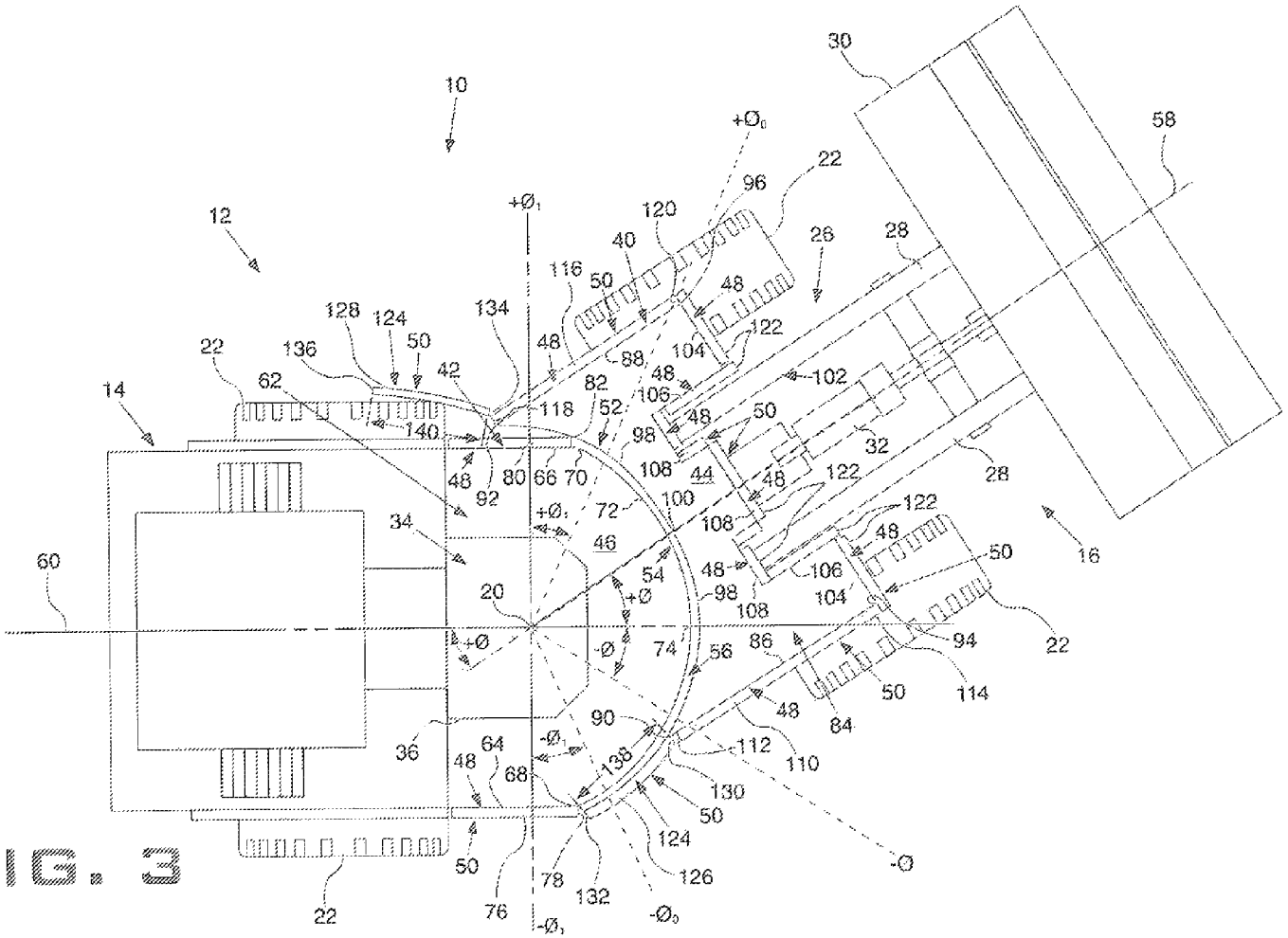
FIG. 3 is a top plan view of an exemplary disclosed platform system for an articulated machine in an articulated position.

An exemplary embodiment of an articulated machine 10 having a platform system 12 is illustrated in FIG. 1. The articulated machine 10 can include a front frame 14 and a rear frame 16 pivotally coupled together at at least one articulation joint 18 such that front frame 14 pivots with respect to rear frame 16 along a vertical articulation axis 20, defined as the center longitudinal axis of the articulation joint 18 and the axis of articulation between the front frame 14 and the rear frame 16, in a manner to provide relative articulating movement between the front frame 14 and the rear frame 16 to position the articulated machine 10 during operation. In the illustrated exemplary embodiment as shown in FIGS. 1-3, the articulated machine 10 is shown in the context of an articulated wheel loader. However, the platform system 12 of the present disclosure is equally applicable to any articulated machine 10 which includes a front frame 14 and a rear frame 16 pivotally coupled together at an articulation joint 18 in a manner to provide relative articulating movement between the front frame 14 and the rear frame 16 to position the articulated machine 10 during operation, including but not limited to a scraper, a motor grader, an articulated truck, and the like. Each of the front frame 14 and the rear frame 16 can include one or more, or a set of ground engaging propulsion devices or mechanisms 22, such as wheels, attached to and supporting the front frame 14 and the rear frame 16. The articulated machine 10 also includes at least one power source, such as an engine shown generally at 24, as well as associated components including but not limited to a transmission (not shown), to power the articulated machine 10 and drive one or more of the ground engaging propulsion devices or mechanisms 22. The at least one power source 24 can be mounted to the rear frame 16 within an engine compartment, or alternatively, can be mounted to or within the front frame 14. In other embodiments, the articulated machine 10 can have a power source 24 mounted on or within the rear frame 16 as provided above, as well as an additional power source such as 24 mounted on or within, or otherwise associated with the front frame 14, depending upon the particular type or configuration of an individual articulated machine 10. In the context of the exemplary illustrated embodiment of FIGS. 1-3 wherein the articulated machine 10 is embodied as a wheel loader, the front frame 14 of the articulated machine 10 can include a linkage assembly 26 which can be hydraulically actuated and can include one or more lift arms 28. Each of the one or more lift arms 28 may extend pivotally outward from the front frame 14 from a first end pivotally coupled with the front frame 14 to a second end which can be pivotally coupled with an implement 30. Additionally, in the presently illustrated, exemplary embodiment, at least one hydraulic actuator 32 may be operatively connected between the one or more lift arms 28, the front frame 14 and/or the implement 30 to actuate and position the lift arms 28 and/or the implement 30 with respect to the front frame 14 of the articulated machine 10 in any conventional manner known by one of ordinary skill in the art.

The articulated machine 10 also includes an operators station, shown generally at 34, within which the operator is positioned during operation of the articulated machine 10 and includes one or more of a plurality of controls, devices, and systems (not shown) utilized by the operator to operate and drive the articulated machine 10. In one embodiment, the operators station 34 can be housed within a substantially enclosed cab 36 which can include a plurality of front, rear, and side windows surrounding the operators station which can be accessed via at least one door 38 disposed within a side wall of the enclosed cab 36. The operators station 34 and cab 36, if included, can be mounted on or within the rear frame 16. Alternatively, the operators station 34 and cab 36 can be supported by the rear frame 16 and can be positioned over the articulation joint 18. In another embodiment, the operators station 34 and cab 36 can be mounted on or within the front frame 14, or can be supported by the front frame 14 and positioned over the articulation joint 18.

The platform system 12 of the articulated machine 10 can include at least one front frame platform 40 mounted on and/or pivotally supported by the front frame 14 and at least one rear frame platform 42 mounted on and/or pivotally supported by the rear frame 16, wherein by virtue of the fixed attachment and/or mounting of the at least one front frame platform 40 to the front frame 14 and the fixed attachment and/or mounting of the at least one rear frame platform 42 to the rear frame 16, each one of the at least one front frame platforms 40 articulates or pivots with respect to each one of the at least one rear frame platforms 42, in unison and in a corresponding degree with the articulation of the front frame 14 with respect to the rear frame 16, respectively. In one embodiment, each one of the at least one front frame platforms 40 includes a substantially horizontal top surface 44 which aligns and is coplanar with a substantially horizontal top surface 46 of an adjacent one of the at least one least one rear frame platforms 42. Furthermore, as illustrated, in part, by the exemplary embodiment of FIG. 1 and as further disclosed herein, the outer peripheral edges 48 of each of the at least one front frame platforms 40 and the at least one rear frame platforms 42 include a plurality of substantially interconnected guard rails 50. Additionally, in one embodiment, each one of the at least one front frame platforms 40 includes an interior edge 52 which is aligned with and faces and/or interconnects with a uniformly oriented, adjacent interior edge 54 of an adjacent one of the at least one rear frame platforms 42, wherein, in one example, a complimentary, pivotally and radially aligned pivotal and/or rotational interface 56 is formed therebetween such that the spacing and alignment between adjacent portions of the interior edges 52, 54 are maintained as the front frame platform 40 pivots in an equal but opposite angular degree with respect to the rear frame platform 42 (respectively), in unison with and in a corresponding degree with the articulation between the front frame 14 and the rear frame 16.

FIG. 2 and FIG. 3 illustrate representations of top views of the exemplary embodiment of an articulated machine 10 having a platform system 12 illustrated in FIG. 1, and illustrate additional detail over what is shown in FIG. 1. As illustrated in FIG. 2 and FIG. 3, front frame 14 can include a longitudinal centerline, such as, for example, longitudinal center axis 58, and similarly, rear frame 16 can include a longitudinal centerline, such as, for example, longitudinal center axis 60. The longitudinal center axis of the front frame 14 intersects with the longitudinal center axis of the rear frame 16 at the vertical articulation axis 20 of the articulation joint 18 which pivotally couples the front frame 14 to the rear frame 16. Accordingly, the articulation angle $\theta$ between the front frame 14 and the rear frame 16 is formed by the intersection of the longitudinal center axis 58 of the front frame 14 and the longitudinal center axis 60 of the rear frame 16 at the vertical articulation axis 20. FIG. 2 provides an exemplary illustration of the front frame 14 and rear frame 16 and the longitudinal center axes 58, 60 (respectively) thereof linearly aligned at an articulation angle $\theta$ of zero degrees, and additionally illustrates the full left articulation of $+\theta$ (as additionally illustrated in FIG. 3) and full right articulation angle of $-\theta$ in phantom. As described herein, the at least one front frame platform 40 is fixedly attached to articulate or pivot in unison with the front frame 14 and the at least one rear frame platform 42 is fixedly attached to articulate or pivot in unison with the rear frame 16 of the articulated machine 10, and as a result, the degree of angular or pivotal displacement between the front frame platform 40 and the rear frame platform 42 is equivalent to the degree of articulation defined by the articulation angle $\theta$ between the longitudinal center axis 58 of the front frame 14 with the longitudinal center axis 60 of the rear frame 16.

Various components of the front frame 14 of the articulated machine 10 may be spaced in parallel and/or horizontal offset relation from the longitudinal center axis 58 of the front frame 14. For example, in addition to other components of the articulated machine 10, the ground engaging propulsion devices or mechanisms 22, such as wheels can project a given distance laterally from the longitudinal center axis 58 of the front frame 14 and the longitudinal center axis 60 of the rear frame 16 in a symmetrical fashion. Additionally, in embodiments wherein the articulated machine 10 is a wheel loader which includes a pair of lift arms 28, each lift arm 28 can be spaced in parallel and/or horizontal offset relation at an equal distance from the longitudinal center axis 58 of the front frame 14. In alternative embodiments wherein the articulated machine 10 is embodied as a wheel loader, a single lift arm 28 may extend pivotally outward in substantial alignment with the longitudinal center axis 58 of the front frame 14 from a first end pivotally coupled with the front frame 14 to a second end which can be pivotally coupled with an implement 30.

As shown in FIG. 1 and as further illustrated in FIG. 2 and FIG. 3, in one embodiment, the rear frame platform 42 can be fixedly attached to the rear frame 16, and the substantially horizontal top surface 46 of the rear frame platform 42 can form at least a portion of the upper surface 62 of the rear frame 16 of the articulated machine 10. The operators station 34 and cab 36 can be mounted on and/or extend above the top surface 46 of the rear frame platform 42. One or more portions of the top surface 46 of the rear frame platform 42 can be defined, in part, as extending laterally between either a side edge and/or wall of the operators station and cab and one or more outer side edges, such as first outer side edge 64 or second outer side edge 66 of the top surface 46 of the rear frame platform 42, or between outer side edges (such as 64 and 66) on either side of the top surface 46 of the rear frame platform 42. Additionally, in one embodiment, one or more portions of the top surface 46 of the rear frame platform 42 can form a path or operator walkway from the operators station 34 and cab 36 to an interior edge 54 of the top surface 46 of the rear frame platform 42 which adjacently and pivotally aligns and/or interconnects with at least a portion of an interior edge 52 of the top surface 44 of the front frame platform 40 for operator movement therebetween. In one embodiment, each of the first outer side edge 64 and the second outer side edge 66 includes a front terminal end, 68 and 70, respectively, wherein each front terminal end 68, 70 connects with and defines the ends of an interior front edge 72 of the top surface 46 of the rear frame platform 42 such that the interior front edge 72 extends laterally along the front boundary of the interior of the top surface 46 of the rear frame platform 42 from the front terminal end 68 of the first outer side edge 64 to the front terminal end 70 of the second outer side edge 66 of the rear frame platform 42. As such, the front terminal ends 68, 70 of the first and second outer side edges 64, 66 (respectively) can represent connection and/or transition points between the outer side edges 64, 66 and the interior front edge 72 of the top surface 46 of the rear frame platform 42. In one embodiment, the interior front edge 72 of the top surface 46 of the rear frame platform 42 includes a midpoint 74 centered along the surface of the interior front edge 72 in between the front terminal ends 68, 70 of the outer side edges 64, 66 (respectively). In one example, the midpoint 74 of the interior front edge 72 aligns with and is intersected by the longitudinal center axis 60 of the rear frame 16, and as such, can form the frontward-most, longitudinal boundary of the top surface 46 of the rear frame platform 42.

In the embodiment shown in FIG. 1 and further illustrated in FIG. 2 and FIG. 3, the first outer side edge 64 and the second outer side edge 66 can represent lateral outer peripheral edges 48 of the top surface 46 of the rear frame platform 42 as well as lateral outer peripheral edges of the rear frame 16 of the articulated machine 10. In the exemplary embodiment illustrated in FIGS. 1-3, one or more adjacently aligned and/or interconnected first outer side guard rails 76 extend vertically a distance above the top surface 46 of the rear frame platform 42 forming a linear vertical boundary at or adjacent to, along, and substantially perpendicularly aligned with the first outer side edge 64, terminating at a front terminal end 78 at or substantially adjacent to the front terminal end 68 of the first outer side edge 64 of the top surface 46 of the rear frame platform 42. Similarly, one or more adjacently aligned and/or interconnected second outer side guard rails 80 extend vertically a distance above the top surface 46 of the rear frame platform 42 forming a linear vertical boundary at or adjacent to, along, and substantially perpendicularly aligned with the second outer side edge 66, terminating at a front terminal end 82 at or substantially adjacent to the front terminal end 70 of the second outer side edge 66 of the top surface 46 of the rear frame platform 42. Alternatively, the entirety or any portion of the first outer side edge 64 and/or a second outer side edge 66 representing an outer peripheral side edge 48 of the top surface 46 of the rear frame platform 42 can include one or more guard rails, hand rails, or any other reinforced protective structural boundary extending a height vertically above the top surface 46 of the rear frame platform 42 at or adjacent to and along any outer peripheral side edge 48.

In the embodiment shown in FIG. 1 as well as FIG. 2 and FIG. 3, the front frame platform 40 can be fixedly attached to the front frame 14, and the substantially horizontal top surface 44 of the front frame platform 40 can form at least a portion of the upper surface 84 of the front frame 14 of the articulated machine 10. One or more portions of the top surface 44 of the front frame platform 40 can be defined, in part, as extending laterally between one or more outer side edges (such as first outer side edge 86 or second outer side edge 88, as provided herein) and one or more inner side edges (such as inner side edges 106, as provided herein), between one or more inner side edges (such as inner side edges 106), or between outer side edges on either side of the top surface 44 of the front frame platform 40 (such as first and second outer side edges 86, 88). Additionally, one or more portions of the top surface 44 of the front frame platform 40 can be defined, in part, as extending longitudinally between one or more interior rear edges 52 (each of which can align or interconnect with a correspondingly aligned one of the one or more interior front edges 54 of the top surface 46 of the rear frame platform 42 to provide a complimentary interface 56 which provides for mutually adjacent pivotal movement, as discussed herein) and one or more front edges of the top surface of the front frame platform 40 (such as front edge 102; outer front edges 104 or inner front edges 108, as provided herein).

In one embodiment, each of the one or more portions of the top surface 44 of the front frame platform 40 can include a first outer side edge 86 and a second outer side edge 88, wherein each of the first outer side edge 86 and the second outer side edge 88 can extend from a rear initial end, 90 and 92, respectively, to a front terminal end, 94 and 96, respectively. In one embodiment, each respective rear initial end 90, 92 of each of the first outer side edge 86 and the second outer side edge 88 can connect with and define the ends of an interior rear edge 98 of the top surface 44 of the front frame platform 40 such that the interior rear edge 98 extends laterally along the rear boundary of the interior of the top surface 44 of the front frame platform 40 from the rear initial end 90 of the first outer side edge 86 to the rear initial end 92 of the second outer side edge 88 of the front frame platform 40. As such, the rear initial ends 90, 92 of the first and second outer side edges 86, 88 (respectively) can represent connection and/or transition points between the outer side edges 86, 88 and the interior rear edge 98 of the top surface 44 of the front frame platform 40. In one embodiment, the interior rear edge 98 of the top surface 44 of the front frame platform 40 includes a midpoint 100 centered along the surface of the interior rear edge 98 in between the rear initial ends 90, 92 of the outer side edges 86, 88 (respectively). In one example, the midpoint 100 of the interior rear edge 98 of the top surface 44 of the front frame platform 40 aligns with and is intersected by the longitudinal center axis 58 of the front frame 14.

Additionally, each of the one or more portions of the top surface 44 of the front frame platform 40 can include a front edge 102 which can connect to, and in one embodiment, extend between the front terminal end 94 of the first outer side edge 86 and a front terminal end 96 of the second outer side edge 88. Each first outer side edge 86, second outer side edge 88, and front edge 102 can include one or more or a series of individual or interconnected straight and/or contoured edges to form one or more portions, segments, and/or shapes of each of the one or more portions of the top surface 44 of the front frame platform 40 depending not only upon the type of articulated machine 10 upon which the front frame platform 40 is mounted, but also the various structures, systems, and/or components specific to the particular articulated machine 10 upon which the front frame platform 40 is mounted. As such, each of the one or more portions of the top surface 44 of the front frame platform 40 can be formed to conform to, extend around and/or adjacent to the various spatial configurations and/or placements, shapes, and/or arrangements of the various structures, systems, and/or components specific to the particular articulated machine 10 upon which the front frame platform 40 is mounted to provide the operator with access for inspection, repair, assembly, disassembly, cleaning, maintenance, and/or servicing of these various components. Furthermore, a plurality of adjacently aligned and/or interconnected guard rails 50 can extend vertically a distance above the top surface 44 of the front frame platform 40 forming a linear vertical boundary adjacent to, along, and perpendicularly aligned with each of the one or more segments of the first outer side edge 86, second outer side edge 88, and front edge 102.

As shown in the exemplary embodiments illustrated in FIG. 1 as well as further illustrated in FIG. 2 and FIG. 3, the first outer side edge 86 and the second outer side edge 88 can represent lateral outer peripheral edges 48 of the top surface 44 of the front frame platform 40 as well as lateral outer peripheral edges of the front frame 14 of the articulated machine 10. Additionally, in the context of the exemplary illustrated embodiment of FIGS. 1-3 wherein the articulated machine 10 is embodied as a wheel loader, a series of interconnected outer front edges 104, inner side edges 106, and inner front edges 108 can represent outer peripheral edges 48 of the top surface 44 of the front frame platform 40 and can extend in interconnected fashion between the front terminal end 94 of the first outer side edge 86 to the front terminal end 96 of the second outer side edge 88 to form a recessed or contoured front profile of the top surface 44 of the front frame platform 40 which conforms to the shape and position of the linkage assembly 26 while permitting the full range of motion of the one or more lift arms 28 thereof. In other embodiments, the front profile of the top surface 44 of the front frame platform 40 can include a variety of alternative shapes, profiles, or contours to conform not only to linkage assemblies and associated components of wheel loaders having alternative shapes and configurations (including but not limited to embodiments wherein the articulated machine 10 is embodied as a wheel loader having a single lift arm 28, as provided above), but also the shapes and positions of various components of other articulated machines 10. Furthermore, one or more portions of the top surface 44 of the front frame platform 40 as sell as the top surface 46 of the rear frame platform 42, and the associated outer side edges 86, 88, 64, 66 as discussed above, can be formed to protrude outward over each of the ground engaging propoulsion devices 22, to thus act as fenders or shields from any mud, water, rocks, or any other debris from being released onto the articulated machine 10.

As shown in FIG. 1 and as further illustrated in FIG. 2 and FIG. 3, in one embodiment, one or more adjacently aligned first outer side guard rails 110 can extend vertically a distance above the top surface 44 of the front frame platform 40 forming a linear vertical boundary at or adjacent to, along, and substantially perpendicularly aligned with the first outer side edge 86 from a rear initial end 112 at or substantially adjacent to the rear initial end 90 of the first outer side edge 86 of the top surface 44 of the front frame platform 40 to a front terminal end 114 at or substantially adjacent to the front terminal end 94 of the first outer side edge 86 of the front frame platform 40. Similarly, one or more adjacently aligned second outer side guard rails 116 can extend vertically a distance above the top surface 44 of the front frame platform 40 forming a linear vertical boundary at or adjacent to, along, and substantially perpendicularly aligned with the second outer side edge 88 from a rear initial end 118 at or substantially adjacent to the rear initial end 92 of the second outer side edge 88 of the top surface 44 of the front frame platform 40 to a front terminal end 120 at or substantially adjacent to the front terminal end 96 of the second outer side edge 88 of the front frame platform 40. Additionally, and in a similar fashion, one or more adjacently aligned front guard rails 122 can extend vertically a distance above the top surface 44 of the front frame platform 40 forming a linear vertical boundary at or adjacent to, along, and substantially perpendicularly aligned with the series of interconnected outer front edges 104, inner side edges 106, and inner front edges 108, extending from the front terminal end 114 of the first outer side guard rails 110 to the front terminal end 120 of the second outer side guard rails 116.

As provided herein, each one of the one or more front frame platforms 40 can include an interior edge 52, such as interior rear edge 98, which is aligned with and faces or interconnects with a uniformly oriented, adjacent interior edge 54, such as interior front edge 72, of an adjacent one of the one or more rear frame platforms 42, forming a complimentary, pivotally and radially aligned pivotal and/or rotational interface 56 therebetween such that the spacing and alignment between adjacent portions of the interior edges 52, 54 is maintained as well as a protected path or operator walkway from the rear frame platform 42 to the front frame platform 40 for operator movement therebetween throughout the full range of pivotal and/or rotational movement between the front frame platform 40 and the rear frame platform 42 as the front frame platform 40 pivots in an equal but opposite angular degree with respect to the rear frame platform 42, in unison with and in a corresponding degree with the articulation between the front frame 14 and the rear frame 16. In one embodiment, the interior front edge 72 of the top surface 46 of the rear frame platform 42 can have a contoured and/or arcuate profile which extends from the front terminal end 68 of the first outer side edge 64 to the front terminal end 70 of the second outer side edge 66 of the top surface 46 of the rear frame platform 42, and the interior rear edge 98 of the top surface 44 of the front frame platform 40 can have a contoured and/or arcuate profile which extends from the rear initial end 90 of the first outer side edge 86 to the rear initial end 92 of the second outer side edge 88 of the top surface 44 of the front frame platform 40. The contoured and/or arcuate profile of the interior front edge 72 of the rear frame platform 42 can be complimentary and uniformly oriented and/or aligned with that of the interior rear edge 98 of the front frame platform 40, as well as the radial path of mutually independent and opposite relative angular rotational and/or pivotal movement between the front frame platform 40 and the rear frame platform 42 to thus provide for equal and opposite relative angular rotational and/or pivotal movement while maintaining the spacing and alignment between adjacent portions of the interior edges 72, 98. In one embodiment, the contoured and/or arcuate profile of the interior front edge 72 of the rear frame platform 42 is substantially convex and the interior rear edge 98 of the front frame platform 40 has a substantially concave contoured and/or arcuate profile which matches and is complimentary with that of the convex contoured and/or arcuate profile of the interior front edge 72 of the rear frame platform 42 in uniformly adjacent offset relation. Additionally, or alternatively, the interior front edge 72 of the rear frame platform 42 and the interior rear edge 98 of the front frame platform 40 can form concentric, evenly spaced arcs which in one embodiment, are concentric about and/or centered with respect to the vertical articulation axis 20. In one example, the radius from the vertical articulation axis 20 to the interior rear edge 98 of the front frame platform 40 is slightly greater than that between the vertical articulation axis 20 and the interior front edge 72 of the rear frame platform 42, wherein in one example, the distance or offset between the respective interior front edge 72 and interior rear edge 98 of the respective rear and front frame platforms 42, 40 can define the pivotal and/or rotational interface 56 which at least in part, defines a path of mutually independent and opposite relative angular rotational and/or pivotal movement between the front frame platform 40 and the rear frame platform 42. In one embodiment, the pivotal and/or rotational interface 56 can be a gap which is formed to maintain an evenly spaced separation between and along adjacent portions of the interior rear edge 98 of the front frame platform 40 and the interior front edge 72 of the rear frame platform 42 while permitting the opposing relative angular rotational and/or pivotal movement between the front frame platform 40 and the rear frame platform 42. Alternatively, the pivotal and/or rotational interface 56 can be a joint, such as a tongue and groove joint, or other connection which forms an overlapping, interconnected, and/or other interface which joins adjacent portions of the interior rear edge 98 of the front frame platform 40 and the interior front edge 72 of the rear frame platform 42 while permitting an opposing relative angular rotational and/or pivotal movement therebetween.

Additionally, each of the one or more front frame platforms 40 and/or each of the one or more rear frame platforms 42 can include one or more pivotal/rotational interface guard rails 124 which can be positioned such that all or a portion of each pivotal/rotational interface guard rail 124 can extend contiguously between and interconnect at least one of the one or more guard rails 50 of the front frame platform 40 and at least one of the one or more guard rails 50 of the rear frame platform 42 to form a substantially contiguous connection and maintain a protective barrier between the guard rails 50 of the front frame platform 40 and those of the rear frame platform 42 throughout the range of pivotal and/or rotational angular movement and displacement between the adjacent front frame and rear frame platforms 40, 42. In one embodiment, the one or more pivotal/rotational interface guard rails 124 can be positioned along, adjacent to and/or aligned with the pivotal and/or rotational interface 56 as well as the path of mutually independent and opposite relative angular rotational and/or pivotal movement between the front frame platform 40 and the rear frame platform 42, wherein in one example, the one or more pivotal/rotational interface guard rails 124 include a first lateral guard rail 126 and a second lateral guard rail 128. As shown in the exemplary embodiment illustrated in FIG. 1 and as further illustrated in FIG. 2 and FIG. 3, the first lateral guard rail 126 can be fixedly attached to pivot and/or rotate in unison with the front frame platform 40, and can include a first or inner end 130 attached to the front frame platform 40 at or substantially adjacent to the rear initial end 90 of the first outer side edge 86 of the front frame platform 40 as well as the rear initial end 112 of the one or more first outer side guard rails 110. The first lateral guard rail 126 can also include a second or outer end 132 which extends radially outward beyond the first outer side edge 86 of the front frame platform 40 and can be positioned distally with respect to the longitudinal center axis 58 of the front frame 14. In one embodiment, the first lateral guard rail 126 can extend linearly from its first or inner end 130 to its second or outer end 132. Alternatively, or additionally, the first lateral guard rail 126 can have an arcuate, contoured profile extending from its first or inner end 130 to its second or outer end 132 which can be substantially consistent and/or uniformly aligned with that of the interior front edge 72 of the rear frame platform 42 (as well as the pivotal and/or rotational interface 56 and path of angular rotational and/or pivotal movement between the front frame platform 40 and the rear frame platform 42) such that the first lateral guard rail 126 extends vertically a distance above the top surfaces 44, 46 of the front and rear frame platforms 40, 42 (respectively) and forms a linear vertical boundary at or adjacent to, along, and substantially perpendicularly aligned with a portion of the interior front edge 72 of the rear frame platform 42 between the front terminal ends 68, 78 of the first outer side edge 64 and first outer side edge guard rails 76 (respectively) of the rear frame platform 42 and the rear initial ends 90, 112 of the first outer side edge 86 and first outer side guard rails 110 (respectively) of the front frame platform 40 as the front frame platform 40 pivots and/or rotates with respect to the rear frame platform 42 in unison and corresponding angular displacement with any degree of leftward articulation between the front frame 14 and the rear frame 16 between an articulation angle of zero degrees and the full left articulation of +θ degrees (as illustrated in FIG. 3), as further described herein.

As further shown in the exemplary embodiment illustrated in FIG. 2 and FIG. 3, the second lateral guard rail 128 can be fixedly attached to pivot and/or rotate in unison with the front frame platform 40, and can include a first or inner end 134 attached to the front frame platform 40 at or substantially adjacent to the rear initial end 92 of the second outer side edge 88 of the front frame platform 40 as well as the rear initial end 118 of the one or more second outer side guard rails 116. The second lateral guard rail 128 can also include a second or outer end 136 which extends radially outward beyond the second outer side edge 88 of the front frame platform 40 and can be positioned distally with respect to the longitudinal center axis 58 of the front frame 14. In one embodiment, the second lateral guard rail 128 can extend linearly from its first or inner end 134 to its second or outer end 136. Alternatively, or additionally, the second lateral guard rail 128 can have an arcuate, contoured profile extending from its first or inner end 134 to its second or outer end 136 which can be substantially consistent and/or uniformly aligned with that of the interior front edge 72 of the rear frame platform 42 (as well as the pivotal and/or rotational interface 56 and path of angular rotational and/or pivotal movement between the front frame platform 40 and the rear frame platform 42) such that the second lateral guard rail 128 extends vertically a distance above the top surfaces 44, 46 of the front and rear frame platforms 40, 42 (respectively) and forms a linear vertical boundary at or adjacent to, along, and substantially perpendicularly aligned with a portion of the interior front edge 72 of the rear frame platform 42 between the front terminal ends 70, 82 of the second outer side edge 66 and second outer side edge guard rails 80 (respectively) of the rear frame platform 42 and the rear initial ends 92, 118 of the second outer side edge 88 and second outer side guard rails 116 (respectively) of the front frame platform 40 as the front frame platform 40 pivots and/or rotates with respect to the rear frame platform 42 in unison and corresponding angular displacement with any degree of rightward articulation between the front frame 14 and the rear frame 16 between an articulation angle of zero degrees and the full right articulation of $-\theta$ degrees, as further described herein.

As provided herein, the at least one front frame platform 40 is fixedly attached to articulate or pivot in unison with the front frame 14 and the at least one rear frame platform 42 is fixedly attached to articulate or pivot in unison with the rear frame 16 of the articulated machine 10, and as a result, the degree of angular or pivotal displacement $\theta_1$ between the front frame platform 40 and the rear frame platform 42 is equivalent to the degree of articulation defined by the articulation angle $\theta$ between the longitudinal center axis 58 of the front frame 14 with the longitudinal center axis 60 of the rear frame 16. Accordingly, in one embodiment, the degree of leftward angular pivotal and/or rotational displacement between the front frame platform 40 and the rear frame platform 42 between a pivotal and/or rotational displacement angle of $+\theta_0$ degrees (which can correspond to an aligned or initial position of the front frame platform 40 and rear frame platform 42 such as when the longitudinal center axes 58, 60 of the front frame 14 and rear frame 16, respectively, are aligned at an articulation angle of zero degrees), and a maximum leftward angular pivotal and/or rotational displacement angle of $+\theta_1$ degrees, is equivalent to the degree of leftward articulation between the front frame 14 and the rear frame 16 between an articulation displacement angle of zero degrees and the maximum leftward articulation displacement angle of $+\theta$ degrees. Similarly, in one embodiment, the degree of rightward angular pivotal and/or rotational displacement between the front frame platform 40 and the rear frame platform 42 between a pivotal and/or rotational displacement angle of $-\theta_0$ degrees (which can correspond to an aligned or initial position of the front frame platform 40 and rear frame platform 42 such as when the longitudinal center axes 58, 60 of the front frame 14 and rear frame 16, respectively, are aligned at an articulation angle of zero degrees), and a maximum rightward angular pivotal and/or rotational displacement angle of $-\theta_1$ degrees, is equivalent to the degree of rightward articulation between the front frame 14 and the rear frame 16 between an articulation displacement angle of zero degrees and the maximum rightward articulation displacement angle of $-\theta$ degrees. Furthermore, in one example, the maximum leftward articulation displacement angle of $+\theta$ degrees between the front frame 14 and the rear frame 16 as well as the maximum leftward angular pivotal and/or rotational displacement angle of $+\theta_1$ degrees between the front frame platform 40 and the rear frame platform 42 can be equivalent to the maximum rightward articulation displacement angle of $-\theta$ degrees between the front frame 14 and the rear frame 16 as well as the a maximum rightward angular pivotal and/or rotational displacement angle of $-\theta_1$ degrees between the front frame platform 40 and the rear frame platform 42. In other embodiments, and depending upon the configuration of the particular articulated machine 10, the foregoing maximum leftward articulation displacement angles of $+\theta$, $+\theta_1$ degrees between the front frame 14 and the rear frame 16 as well as the front frame platform 40 and the rear frame platform 42 can be dissimilar or non-equivalent to the maximum rightward articulation displacement angle of $-\theta$, $-\theta_1$ degrees between the front frame 14 and the rear frame 16 as well as the front frame platform 40 and the rear frame platform 42.

Accordingly, in one embodiment, each of the first and second lateral guard rails 126, 128 have lengths 138, 140, respectively, which can extend from their respective first or inner ends 130, 134 to their second or outer ends 132, 136 which are at least as long as and extend throughout either the maximum rightward or leftward angular pivotal and/or rotational displacement between the front frame platform 40 and the rear frame platform 42 in order to form a boundary along any radial length of the interior front edge 72 of the top surface 46 of the rear frame platform 42 which is exposed as an outer peripheral edge thereof which extends between the front terminal end 78 of the one or more first outer side guard rails 76 of the rear frame platform 42 and the rear initial end 112 of the one or more first outer side guard rails 110 of the front frame platform 40, and similarly, any radial length of the interior front edge 72 of the rear frame platform 42 which is exposed as an outer peripheral edge of the rear frame platform 42 and is positioned between the front terminal end 82 of the one or more second outer side guard rails 80 of the rear frame platform 42 and the rear initial end 118 of the one or more second outer side guard rails 116 of the front frame platform 40. In one embodiment, the first lateral guard rail 126 can have a length 138 which extends from its first or inner end 130 to its second or outer end 132 which is at least as long as and/or is equivalent to the maximum leftward angular pivotal and/or rotational displacement angle of $+\theta_1$ degrees, and in one example, is additionally at least as long as and/or is equivalent to the maximum leftward articulation displacement angle of $+\theta$ degrees. As a result, as the front frame platform 40 pivots and/or rotates to any degree of leftward angular pivotal and/or rotational displacement between a pivotal and/or rotational displacement angle of $+\theta_0$ degrees and a maximum leftward angular pivotal and/or rotational displacement angle of $+\theta_1$ degrees in relation to the rear frame platform 42, the first lateral guard rail 126 can rotate and/or pivot in unison with the front frame platform 40 such that all or any portion of the length 138 of the first lateral guard rail 126 which is equivalent to the degree of leftward angular pivotal and/or rotational displacement between the front frame platform 40 and the rear frame platform 42 can be positioned into adjacent alignment with the radial length of the interior front edge 72 of the rear frame platform 42 which is exposed as an outer peripheral edge of the rear frame platform 42 to extend contiguously between and interconnect the angular, lateral, and/or rotational displacement between the front terminal ends 68, 78 of the first outer side edge 64 and first outer side edge guard rails 76 (respectively) of the rear frame platform 42 and the rear initial ends 90, 112 of the first outer side edge 86 and first outer side guard rails 110 (respectively) of the front frame platform 40.

Similarly, in one embodiment, the second lateral guard rail 128 can have a length 140 which extends from its first or inner end 134 to its second or outer end 136 which is at least as long as and/or is equivalent to the rightward angular pivotal and/or rotational displacement angle of $-\theta_1$ degrees, and in one example, is additionally at least as long as and/or is equivalent to the maximum leftward articulation displacement angle of $-\theta$ degrees. As a result, as the front frame platform 40 pivots and/or rotates to any degree of rightward angular pivotal and/or rotational displacement between a pivotal and/or rotational displacement angle of $-\theta_0$ degrees and a maximum rightward angular pivotal and/or rotational displacement angle of $\theta_1$ degrees in relation to the rear frame platform 42, the second lateral guard rail 128 can rotate and/or pivot in unison with the front frame platform 40 such that all or any portion of the length 140 of the second lateral guard rail 128 which is equivalent to the degree rightward of angular pivotal and/or rotational displacement between the front frame platform 40 and the rear frame platform 42 can be positioned into adjacent alignment with the radial length of the interior front edge 72 of the rear frame platform 42 which is exposed as an outer peripheral edge of the rear frame platform 42 to extend contiguously between and interconnect the angular, lateral, and/or rotational displacement between the front terminal ends 70, 82 of the second outer side edge 66 and second outer side edge guard rails 80 (respectively) of the rear frame platform 42 and the rear initial ends 92, 118 of the second outer side edge 88 and second outer side guard rails 116 (respectively) of the front frame platform 40.

Figure 4:
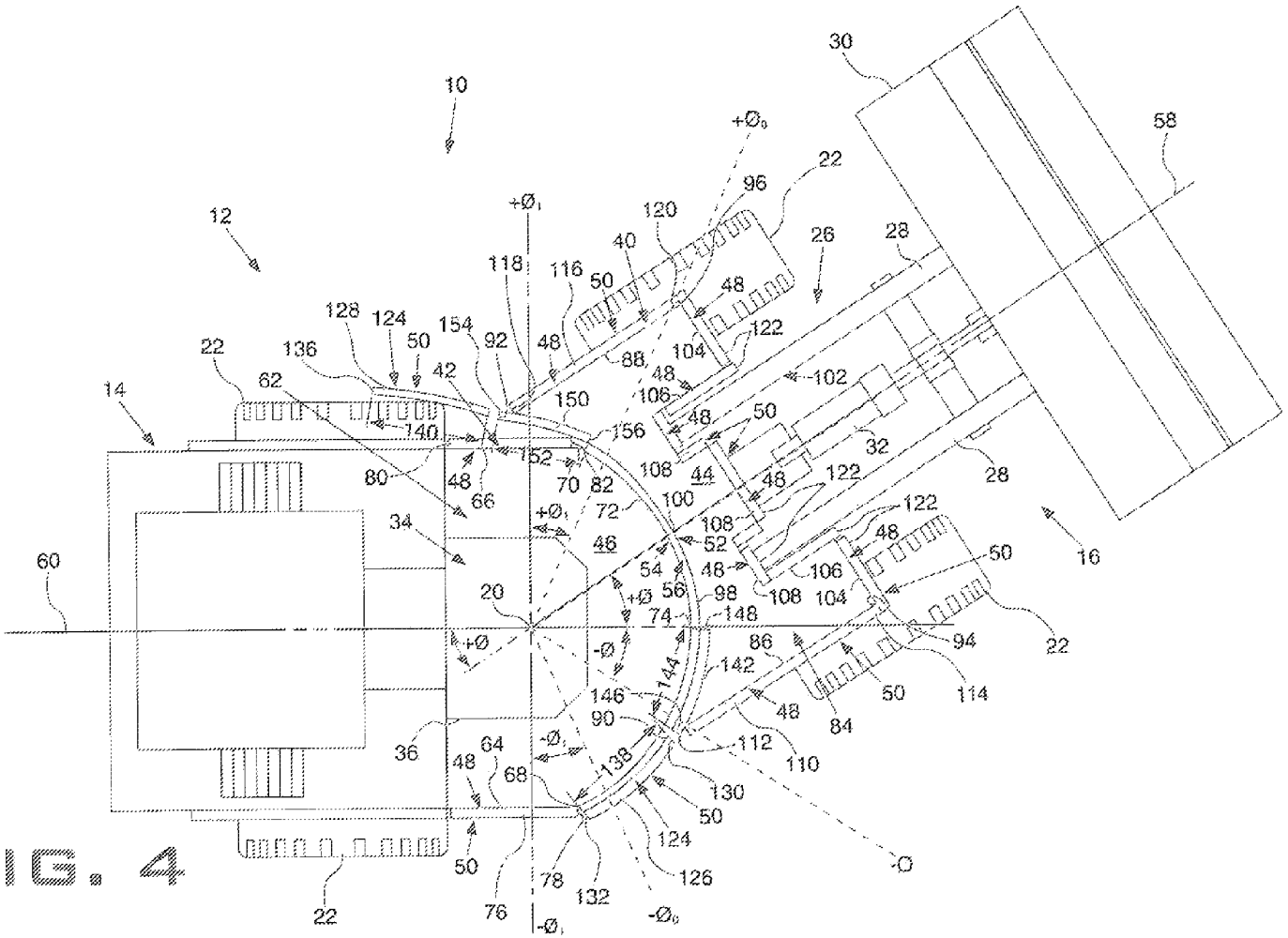
FIG. 4 is a top plan view of an exemplary disclosed platform system for an articulated machine in an articulated position.

In an additional embodiment as shown in FIG. 4, the front frame platform 40 can additionally include a first interface guard rail 142 which can be positioned to extend along, adjacent to and/or aligned with the pivotal and/or rotational interface 56. The first interface guard rail 142 can have a length 144 which extends inwardly along and aligned with the interior rear edge 98 of the front frame platform 40 from a first end 146 at, adjacent, or connected to the first or inner end 130 of the first lateral guard rail 126 as an extension thereof, to a second end 148 proximate to the midpoint 100 of the interior rear edge 98. Furthermore, the front frame platform 40 can also include a second interface guard rail 150 which can be positioned to extend along, adjacent to and/or aligned with the pivotal and/or rotational interface 56. The second interface guard rail 150 can have a length 152 which extends inwardly along and aligned with the interior rear edge 98 of the front frame platform 40 from a first end 154 at, adjacent, or connected to the first or inner end 134 of the second lateral guard rail 128 as an extension thereof, to a second end 156 proximate to the midpoint 100 of the interior rear edge 98. The lengths 144, 152 and contours of the first and second interface guard rails 142, 150 can be substantially equivalent to the lengths 138, 140 of the first and second lateral guard rails 126, 128, respectively as provided above. As such, the first and second interface guard rails 142, 150 can each have a contoured profile which can be consistent and/or aligned with the interior front edge 72 of the rear frame platform 42 as well as respective lengths, 144, 152, which can be at least as long as and extend throughout either the maximum rightward or leftward angular pivotal and/or rotational displacement between the front frame platform 40 and the rear frame platform 42.

Figure 5:
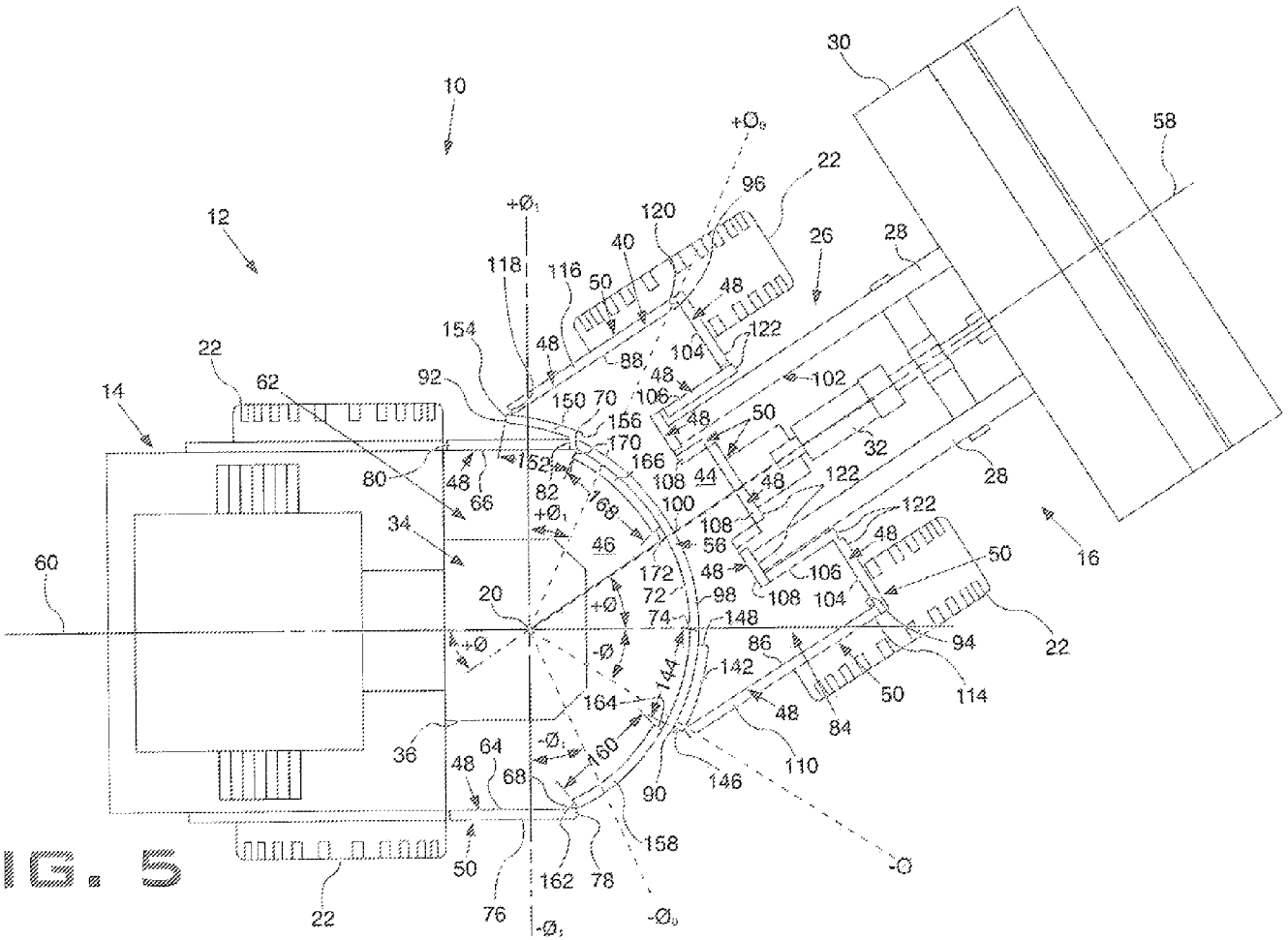
FIG. 5 is a top plan view of an exemplary disclosed platform system for an articulated machine in an articulated position.

In a further embodiment as shown in FIG. 5, front frame platform 40 can include a first interface guard rail 142 and a second interface guard rail 150 which can each be positioned to extend along, adjacent to and/or aligned with the pivotal and/or rotational interface 56. Substantially consistent with the embodiment illustrated in FIG. 4 discussed above, the first and second interface guard rails 142, 150 can have a lengths 144, 152 which extend inwardly along and aligned with the interior rear edge 98 of the front frame platform 40 from first ends 146, 154 at or adjacent to the rear initial ends 90, 92 of the first and second outer side edges 86, 88 (as well as the rear initial ends 112, 118 of the first and second outer side guard rails 110, 116), to second ends 148, 156 proximate to the midpoint 100 of the interior rear edge 98, respectively. Additionally, the rear frame platform 42 can include a first interface guard rail 158 which can be positioned to extend along, adjacent to and/or aligned with the pivotal and/or rotational interface 56. The first interface guard rail 158 can have a length 160 which extends inwardly along and aligned with the interior front edge 72 of the rear frame platform 42 from a first end 162 at, adjacent, or connected to the front terminal end 78 of the first outer side guard rails 76 to a second end 164 proximate to the midpoint 74 of the interior front edge 72. Furthermore, the rear frame platform 42 can include a second interface guard rail 166 which can be positioned to extend along, adjacent to and/or aligned with the pivotal and/or rotational interface 56. The second interface guard rail 166 can have a length 168 which extends inwardly along and aligned with the interior front edge 72 of the rear frame platform 42 from a first end 170 at, adjacent, or connected to the front terminal end 82 of the second outer side guard rails 80 to a second end 172 proximate to the midpoint 74 of the interior front edge 72.

The lengths 160, 168 and contours of the first and second interface guard rails 158, 166 of the rear frame platform 42 as well as the lengths 144, 152 and contours of the first and second interface guard rails 142, 150 of the front frame platform 40 can be substantially equivalent to the lengths 138, 140 and contours of the first and second lateral guard rails 126, 128, respectively. As such, first and second interface guard rails 158, 166 of the rear frame platform 42 as well as the first and second interface guard rails 142, 150 of the front frame platform 40 can each have a contoured profiles which can be consistent and/or aligned with the interior rear edge 98 of the front frame platform 40 and the interior front edge 72 of the rear frame platform 42, respectively, as well as respective lengths, 160, 168, 144, 152 which can be at least as long as and extend throughout either the maximum rightward or leftward angular pivotal and/or rotational displacement between the front frame platform 40 and the rear frame platform 42. In a manner substantially consistent with the first and second lateral guard rails 126, 128 as provided above, the first and second interface guard rails 142, 150 of the front frame platform 40 as well as the first and second interface guard rails 158, 166 of the rear frame platform 42 can extend contiguously between and interconnect at least one of the one or more guard rails 50 of the front frame platform 40 and at least one of the one or more guard rails 50 of the rear frame platform 42 to form a boundary along any radial length of the interior front edge 72 of the top surface 46 of the rear frame platform 42 or any radial length of the interior rear edge 98 of the top surface 44 of the front frame platform 40 which is exposed as outer peripheral edges of the platform system 12 and/or the articulated machine 10 throughout the range of pivotal and/or rotational angular movement and displacement between the front frame platform 40 and the rear frame platform 42 as well as the front frame 14 and rear frame 16 of any articulated machine 10.

The specific shapes, positions, placements, and positions of and between the front frame platform 40 and the rear frame platform 42 as illustrated in FIGS. 1-5 and as disclosed herein are meant to serve as an exemplary configuration of one possible embodiment of a platform system 12 for an articulated machine 10 embodied in the context of the specific components and configurations thereof of the wheel loader as shown in the exemplary embodiment illustrated in FIGS. 1-3. However, the scope of the present disclosure is not limited to the foregoing specific embodiment, but instead is directed to any one or more complimentary front frame platforms 40 and rear frame platforms 42 which may be attached to pivot and/or rotate in unison with the articulation between the front frame 14 and rear frame 16 of any articulated machine 10 and may not only each have a variety of alternative shapes, profiles, or contours to conform to the shapes and positions of various components of a variety of articulated machines 10, but also may have pivotable and/or rotatable guard rails 50 (such as pivotal/rotational interface guard rails 124) which may form a substantially contiguous connection and maintain a protective barrier between portions of adjacent front frame and rear frame platforms 40, 42 exposed as outer peripheral edges of the platform system 12 and/or the articulated machine 10 throughout the range of pivotal and/or rotational angular movement and displacement between the front frame platform 40 and the rear frame platform 42 as well as the front frame 14 and rear frame 16 of any articulated machine 10.

Industrial Applicability

The platform system 12 of the present disclosure may be applicable to any articulated machine 10 and may conform to and extend around and/or adjacent to a variety of spatial configurations and/or placements, shapes, and/or arrangements of various structures, systems, and/or components specific to a variety of articulated machines 10 upon which the platform system 12 may be mounted. The platform system 12 of the present disclosure may also provide increased access to portions of an articulated machine 10 and frame members thereof which are remote from the frame member and operators station at, upon, or within which a cab may be located, and/or are otherwise difficult, inconvenient, and/or dangerous to access in order to perform activities including but not limited to inspection, repair, assembly, disassembly, cleaning, maintenance, and/or servicing of these various components of the articulated machine 10 in the absence of the disclosed platform system. In particular, in one embodiment, the platform system 12 of the present disclosure may provide a protected path or operator walkway between one or more platforms associated with a rear frame 16 and one or more platforms associated with a front frame 14 of an articulated machine 10 for operator movement therebetween throughout the full range of pivotal and/or rotational movement between the one or more front frame platforms 40 and the one or more rear frame platforms 42 as the one or more front frame platforms 40 pivot in an equal but opposite angular degree with respect to the one or more rear frame platforms 42, in unison with and in a corresponding degree with the articulation between the front frame 14 and the rear frame 16. Operation of platform system 12 will now be described.

In one example as shown in the exemplary illustration of FIG. 2, when the articulated machine 10 is in an un-articulated position, the longitudinal center axis 58 of the front frame 14 can intersect and linearly align with the longitudinal center axis 60 of the rear frame 16 at the vertical articulation axis 20 of the articulation joint 18 which pivotally couples the front frame 14 to the rear frame 16 to thus form an articulation angle of zero degrees. In particular, FIG. 2 provides an exemplary illustration of one example of the orientation and positioning between the front frame 14 and rear frame 16 (as well as the front frame platform 40 and the rear frame platform 42) when the longitudinal center axes 58, 60 thereof are linearly aligned at an articulation angle of zero degrees, and, as a result, the articulated machine 10 is maintained in an un-articulated position. In one embodiment, when the front frame 14 is linearly aligned with the rear frame 16 at an articulation angle of zero degrees, the front frame platform 40 can be aligned with the rear frame platform 42 at zero degrees of leftward or rightward angular pivotal and/or rotational displacement. In this position, the midpoint 74 of the interior front edge 72 of the rear frame platform 42 can be aligned with the midpoint 100 of the interior rear edge 98 of the rear frame platform 42, the front terminal end 70 of the second outer side edge 66 of the rear frame platform 42 can be substantially aligned with and positioned adjacent to the rear initial end 92 of the second outer side edge 88 of the front frame platform 40 at an initial leftward angular pivotal and/or rotational displacement angle of $+\theta_0$ degrees. Similarly, the front terminal end 68 of the first outer side edge 64 of the rear frame platform 42 can be substantially aligned with and positioned adjacent to the rear initial end 90 of the first outer side edge 86 of the front frame platform 40 at an initial rightward angular pivotal and/or rotational displacement angle of $-\theta_0$ degrees. As such , in this position, the entirety of the pivotal and/or rotational interface of the interior front edge 72 of the rear frame platform 42 can be substantially aligned with and positioned adjacent to the entirety of the pivotal or rotational interface of the interior rear edge 98 of the front frame platform 40.

Additionally, when the front frame 14 is linearly aligned with the rear frame 16 at an articulation angle of zero degrees, the guard rails 50 along the outer peripheral edges 48 of the rear frame platform 42 positioned proximate and/or adjacent to the interior front edge 72 of the rear frame platform 42 can be linearly aligned with and/or positioned at an adjacent, overlapping, and/or substantially contiguous orientation with the guard rails 50 along the outer peripheral edges 48 of the front frame platform 40 positioned proximate and/or adjacent to its interior rear edge 98 such that the outer peripheral edges 48 of the platform system 12 are bordered and protected by a system of substantially contiguous guard rails, hand rails, or any other reinforced protective structural boundary. In one example of an aligned, un-articulated position as shown by the exemplary embodiment of FIG. 2, the front terminal end 82 of the second outer side guard rails 80 of the rear frame platform 42 can be substantially aligned with and positioned adjacent to the rear initial end 118 of the second outer side guard rails 116 of the front frame platform 40 at an initial leftward angular pivotal and/or rotational displacement angle of $+\theta_0$ degrees, and similarly, the front terminal end 78 of the first outer side guard rails 76 of the rear frame platform 42 can be substantially aligned with and positioned adjacent to the rear initial end 112 of the first outer side guard rails 110 of the front frame platform 40 at an initial rightward angular pivotal and/or rotational displacement angle of $-\theta_0$ degrees.

When the articulated machine 10 is actuated to articulate from an un-articulated position such as that shown in FIG. 2, the front frame 14 can be actuated to pivot or articulate with respect to the rear frame 16 about the articulation joint 18 to any degree of leftward pivotal and/or angular displacement between an articulation angle of zero degrees and the full left articulation of $+\theta$ degrees as well as to any degree of rightward pivotal and/or angular displacement between an articulation angle of zero degrees and the full right articulation of $-\theta$ degrees. For the purposes of the present description, one example of a platform system 12 configured to be utilized in connection with an articulated machine 10 shown in the context of an articulated wheel loader having a front frame 14 and rear frame 16 articulated to a maximum leftward angular pivotal and/or rotational displacement angle of $+\theta$ degrees, and correspondingly, the front frame platform 40 and rear frame platform 42 pivoted and/or rotated to a maximum leftward angular pivotal and/or rotational displacement angle of $+\theta_1$ degrees is described herein for the purposes of providing a general illustration and description of the operation of the present platform system 12 as illustrated in the exemplary embodiment shown in FIG. 3. Notwithstanding, the front frame 14 can be actuated to articulate with respect to the rear frame 16 throughout any degree of leftward or rightward articulation between an articulation angle of zero degrees and the full left articulation of $+\theta$ degrees as well as between an articulation angle of zero degrees and the full right articulation of $-\theta$ degrees, respectively, and correspondingly, the front frame platform 40 can be fixedly attached to articulate or pivot in unison with the front frame 14 to any degree of leftward or rightward angular pivotal and/or rotational displacement between a pivotal and/or rotational displacement angle of $+\theta_0$ degrees and $-\theta_0$ degrees, and a maximum leftward or rightward angular pivotal and/or rotational displacement angle of $+\theta_1$ degrees and $-\theta_1$ degrees, respectively in relation to the rear frame platform 42 in a corresponding and consistent manner with the presently described and illustrated exemplary embodiment shown in FIG. 3.

As illustrated exemplary embodiment shown in FIG. 3, as the front frame 14 is actuated to pivot or articulate with respect to the rear frame 16 from an un-articulated position at zero degrees of pivotal and/or angular displacement to a maximum leftward degree of articulation defined by the full left pivotal and/or angular displacement of $+\theta$ degrees, the front frame platform 40 pivots and/or rotates in unison with the front frame 14 and is angularly and/or pivotally displaced leftward with respect to the rear frame 16 and rear frame platform 42 from a pivotal and/or rotational displacement angle of $+\theta_0$ degrees to the maximum leftward angular pivotal and/or rotational displacement angle of $+\theta_1$ degrees, wherein the leftward pivotal and/or angular displacement between the front frame platform 40 and the rear frame platform 42 from $+\theta_0$ to $+\theta_1$ degrees is equivalent to the degree of leftward articulation between the front frame 14 and the rear frame 16 between zero degrees and the full left pivotal and/or angular displacement of $+\theta$ degrees.

Furthermore, in one example, as the front frame platform 40 pivots and/or rotates in unison with the front frame 14 and is angularly and/or pivotally displaced leftward with respect to the rear frame 16 and rear frame platform 42 as provided above, the interior rear edge 98 of the front frame platform 40 is angularly and/or pivotally displaced leftward to a corresponding degree with respect to the interior front edge 72 of the rear frame platform 42 along the complimentary, pivotally and radially aligned pivotal and/or rotational interface 56. Additionally, the midpoint 100 of the interior rear edge 98, the rear initial ends 92, 118 of the second outer side edge 88 and second outer side guard rails 116, and the rear initial ends 90, 112 of the first outer side edge 86 and first outer side guard rails 110 of the front frame platform 40 are pivotally and/or angularly displaced leftwardly and out of alignment with respect to the midpoint 74 of the interior front edge 72, the front terminal ends 70, 82 of the second outer side edge 66 and second outer side guard rails 80, and the front terminal ends 68, 78 of the first outer side edge 64 and first outer side guard rails 76 of the rear frame platform 42, respectively, to the maximum leftward angular pivotal and/or rotational displacement angle of $+\theta_1$ degrees. As a result, in one example as illustrated by the exemplary embodiment shown in FIG. 3, in this position, a portion of the interior rear edge 98 of the front frame platform 40 extends or is displaced radially leftwardly beyond the interior front edge 72 of the rear frame platform equivalent to the angular or radial distance defined by leftward angular pivotal and/or rotational displacement angle of $+\theta_1$ degrees, extending from the rear initial end 92 of the second outer side edge 88 of the interior rear edge 98 of the front frame platform 40 to the front terminal end 70 of the second outer side edge 66 of the rear frame platform 42. Similarly, in a corresponding fashion, a portion of the interior front edge 72 of the rear frame platform 42 equivalent to the angular or radial distance defined by leftward angular pivotal and/or rotational displacement angle of $+\theta_1$ degrees extends beyond or is exposed and positioned out of adjacent and/or facing alignment with the interior rear edge 98 of the front frame platform 40, extending from the front terminal end 68 of the first outer side edge 64 of the interior front edge 72 of the rear frame platform 42 to the rear initial end 90 of the first outer side edge 86 of the front frame platform 40.

In this position, as illustrated in the exemplary embodiment shown in FIG. 3, the first outer side guard rail 110 can rotate in unison with the front frame platform 40 along the pivotal and/or rotational interface 56 as well as the path of mutually independent and opposite relative angular rotational and/or pivotal movement and throughout the angular or radial distance defined by leftward angular pivotal and/or rotational displacement angle of $+\theta_1$ degrees between the front frame platform 40 and the rear frame platform 42. As a result, in one example, the leftward pivotal and/or rotational movement of the front frame platform 40 can position the length 138 of the first outer side guard rail 110, which is at least as long as and/or is equivalent to the maximum leftward angular pivotal and/or rotational displacement angle of $+\theta_1$ degrees, into adjacent alignment with the exposed portion of the interior front edge 72 of the rear frame platform 42 such that the first lateral guard rail 126 extends vertically a distance above the top surfaces 44, 46 of the front and rear frame platforms 40, 42 (respectively) and forms a linear vertical boundary at or adjacent to, along, and substantially perpendicularly aligned with the portion of the interior front edge 72 of the rear frame platform 42 exposed and extending from the front terminal ends 68, 78 of the first outer side edge 64 and first outer side edge guard rails 76 (respectively) of the rear frame platform 42 to the rear initial ends 90, 112 of the first outer side edge 86 and first outer side guard rails 110 (respectively) of the front frame platform 40.

It will be apparent to those skilled in the art that various modifications and variations can be made to the system of the present disclosure without departing from the scope of the disclosure. Other embodiments will be apparent to those skilled in the art from consideration of the specification and practice of the system disclosed herein. It is intended that the specification and examples be considered as exemplary only, with a true scope of the disclosure being indicated by the following claims and their equivalent.

What is claimed is:

1. A platform system for an articulated machine, comprising:

a first platform pivotally supportable by a front frame of an articulated machine, the front frame pivotally coupled to a rear frame of the articulated machine at an articulation joint;

a second platform pivotally supportable by the rear frame of the articulated machine, the second platform having a first edge which is positioned adjacent to a first edge of the first platform;

each of the first edge of the first platform and the first edge of the second platform having a radial profile which is aligned with a path of pivotal movement between the first platform and the second platform; and one or more pivotal guard rails, each of the one or more pivotal guard rails having a radial profile which is aligned with the path of pivotal movement between the first platform and the second platform.

2. The platform system of claim 1 wherein the radial profile of each of the one or more pivotal guard rails is aligned with one or more of the radial profile of the first edge of the first platform and the radial profile of the first edge of the second platform.

3. The platform system of claim 2 wherein the one or more pivotal guard rails includes a first pivotal guard rail, the first pivotal guard rail attached to pivot in unison with the first platform such that the first pivotal guard rail is movably positioned along the path of pivotal movement between the first platform and the second platform.

4. The platform system of claim 3 wherein the first pivotal guard rail has a length which is at least as long as a maximum pivotal displacement between the first platform and the second platform.

5. The platform system of claim 4 wherein the first edge of the first platform is an interior edge of the first platform, the interior edge of the first platform extending from a first end to a second end.

6. The platform system of claim 5 wherein the first edge of the second platform is an interior edge of the second platform, the interior edge of the second platform extending from a first end to a second end.

7. The platform system of claim 6 wherein the length of the first pivotal guard rail extends radially outward from a first end attached to the first platform adjacent to the first end of the interior edge of the first platform and a second end positioned beyond the interior edge of the first platform.

8. The platform system of claim 7 wherein at least a portion of the length of the first pivotal guard rail is positioned to extend radially along a corresponding portion of the interior edge of the second platform which extends radially outward beyond the first end of the interior edge of the first platform.

9. The platform system of claim 1 wherein the second platform includes a cab.

10. The platform system of claim 9 wherein the articulated machine is a wheel loader, and the front frame includes one or more peripheral edges configured to conform to a shape and position of a linkage assembly of the wheel loader.

11. A platform system, comprising:

a first platform configured to be mounted on a front frame of an articulated machine;

a second platform configured to be mounted on a rear frame of the articulated machine;

the first platform having an interior edge, the interior edge of the first platform extending between a first side edge and a second side edge of the first platform;

the second platform having an interior edge, the interior edge of the second platform extending between a first side edge and a second side edge of the second platform;

the interior edge of the first platform and the interior edge of the second platform configured to define an evenly spaced pivotal interface between adjacent portions of the interior edge of the first platform and the interior edge of the second platform; and one or more side guard rails positioned along at least one of the first side edge and the second side edge of the first platform and at least one of the first side edge and the second side edge of the second platform.

12. The platform system of claim 11 wherein the interior edge of the first platform has an arcuate profile which extends from a rear end of the first side edge of the first platform to a rear end of the second side edge of the first platform.

13. The platform system of claim 12 wherein the interior edge of the second platform has an arcuate profile which extends from a front end of the first side edge of the second platform to a front end of the second side edge of the second platform.

14. The platform system of claim 13 additionally comprising a first pivotal guard rail and a second pivotal guard rail each radially aligned with the pivotal interface, the first pivotal guard rail extending radially outward from first side edge of the first platform and the second pivotal guard rail extending radially outward from the second side edge of the first platform.

15. The platform system of claim 14 wherein the first pivotal guard rail is configured to be pivotally positioned such that at least a portion of a radial length of the first pivotal guard rail extends radially from the rear end of the first side edge of the first platform to the front end of the first side edge of the second platform between at least one of the one or more side guard rails positioned along the first side edge of the first platform and at least one of the one or more side guard rails positioned along the first side edge of the second platform.

16. The platform system of claim 15 wherein the second pivotal guard rail is configured to be pivotally positioned such that at least a portion of a radial length of the second pivotal guard rail extends radially from the rear end of the second side edge of the first platform to the front end of the second side edge of the second platform between at least one of the one or more side guard rails positioned along the second side edge of the first platform and at least one of the one or more side guard rails positioned along the second side edge of the second platform.

17. An articulated machine, comprising:

a front frame of the articulated machine pivotally coupled to a rear frame of the articulated machine at least one articulation joint;

a first platform pivotally supported by a front frame of the articulated machine;

a second platform pivotally supported by the rear frame of the articulated machine;

the first platform configured to pivot with respect to the second platform along a pivotal interface formed between an interior edge of the first platform which is aligned with and adjacent to an interior edge of the second platform;

the first platform having one or more outer edges and one or more outer guard rails positioned along at least one of the one or more outer edges of the first platform;

the second platform having one or more outer edges and one or more outer guard rails positioned along at least one of the one or more outer edges of the second platform; and one or more pivotal guard rails each positioned to extend from the pivotal interface and configured to extend between one of the one or more outer edges of the first platform and one of the one or more outer edges of the second platform as the first platform pivots with respect to the second platform.

18. The articulated machine of claim 17 wherein a degree of pivotal displacement between the first platform and the second platform is substantially equivalent to a degree of pivotal displacement between the front frame and the rear frame.

19. The articulated machine of claim 18 wherein each of the one or more pivotal guard rails have lengths which are configured to extend throughout a maximum degree of pivotal displacement between the first platform and the second platform.

* * * * *